US005195747A

United States Patent [19]

Choy

[11] Patent Number: 5,195,747

[45] Date of Patent: Mar. 23, 1993

[54] GOLF CLUB

[76] Inventor: Jung-Soo Choy, 4104-A Dunwoody Park, Dunwoody, Ga. 30338

[21] Appl. No.: 887,888

[22] Filed: May 26, 1992

[51] Int. Cl.[5] ..... A63B 53/04

[52] U.S. Cl. ..... 273/170; 273/171

[58] Field of Search ..... 273/167-175, 273/194 R, 194 A, 194 B, 77 R, 162 R

[56] References Cited

U.S. PATENT DOCUMENTS

| | | | |
|---|---|---|---|
| 1,561,595 | 11/1925 | Davis | 273/170 |
| 1,894,841 | 1/1933 | Adams | 273/170 |
| 2,098,445 | 11/1937 | Wettlaufer | 273/170 |
| 3,084,940 | 4/1963 | Cissel | 273/173 |
| 3,863,932 | 2/1975 | Lezatte | 273/173 X |
| 3,951,413 | 4/1976 | Bilyeu | 273/170 |
| 3,993,314 | 11/1976 | Harrington et al. | 273/170 |
| 4,180,269 | 12/1979 | Thompson | 273/171 |
| 4,591,160 | 5/1986 | Piragino | 273/173 X |
| 5,076,585 | 12/1991 | Bouquet | 273/171 X |

FOREIGN PATENT DOCUMENTS

| | | | |
|---|---|---|---|
| 4784 | of 1908 | United Kingdom | 273/170 |
| 2200560 | 8/1988 | United Kingdom | 273/171 |

*Primary Examiner*—V. Millin
*Assistant Examiner*—Sebastiano Passaniti
*Attorney, Agent, or Firm*—Kennedy & Kennedy

[57] ABSTRACT

A golf club (10) has an elongated shaft (11), a grip (12), and a club head (13). The club head has an annular channel (26) having a free moving weight (27) therein which maintains the center of inertia of the club head in the same location regardless of the swing plane of the golf club.

8 Claims, 3 Drawing Sheets

GOLF CLUB

TECHNICAL FIELD

This invention relates to golf clubs, and particular to golf clubs which have means for changing torquing characteristics of the club.

BACKGROUND OF THE INVENTION

Golf is a game which requires exacting techniques to achieve a proper swing. One aspect of a proper swing relates to the swing plane which is the plane in which club should substantially move during a swing. The basic determinative factors with regard to the position of a golfer's swing plane is his or her physical stature and his or her address posture. The more a golfer bends over the ball from the waist at address, and the closer he sets his hands to his body, the more upright becomes the plane in which he naturally tends to swing. Conversely, short golfers tend to swing in a flatter plane, i.e. a less upright plane, than tall golfers because their lack of height in relation to the standard length of club shafts forces them to stand farther from the ball. The swing plane also shifts between different clubs because of differences in their relative lengths. For example, a 9 iron is shorter than a 5 iron thereby causing the golfer to swing the 9 iron in a more upright plane than the 5 iron.

Another important aspect of a proper golf swing is the desirability that the head of the club strike the ball at that point of the golf swing where the club head velocity is the greatest and that such speed by maintained into the follow-through. Maximum force of impact between the club face and the ball is obtained without club head torquing when the ball is hit in the "sweet spot" of the club head face. The sweet spot is typically located at the center of the club face and has been thought of as the location on the club face directly forward of the center of gravity of the club head. For example, a golfer may locate the sweet spot of a putter by holding it lightly between the thumb and forefinger at the top end of the grip and then gently tap the face of the putter head with an object such as a ball at different locations on the club face until the club head recoils straight back and forth like a pendulum without twisting or torquing off-line. This approach does locate the sweet spot of the club while essentially at rest. However, as the club is fully swung, often in various swing planes due to swing inconsistencies of golfers of average ability, the sweet spot actually shifts due to redistribution of the mass of the club head with respect to the swing plane where it extends through the club head, and to differences in different speeds of different portions of the club head. Because the sweet spot of a club in motion is determined relative to mass and velocity of the club, it may be referred to as the center of inertia of the golf club. Such shifting of the center of inertia hampers a golfer's ability to make ball contact at the sweet spot. The further a ball is hit from the center of inertia the more it will tend to be misdirected or imparted with a side spin.

It thus is seen that a need remains for a golf club that can substantially maintain its center of inertia or sweet spot in the same location upon the club head regardless of the orientation of the plane in which the club is swung or its velocity. It is to the provision of such therefore that the present invention is primarily directed.

SUMMARY OF THE INVENTION

In a preferred form of the invention, a golf club is provided having a shaft and a head mounted at an end of the shaft. The head has a face and a generally annular channel mounted therein oriented substantially parallel to the face. A weight is located within the channel for free movement therein. With this construction the weight may move to different locations within the channel as the club is swung to distribute mass so as to counter torquing effects of the club.

DETAILED DESCRIPTION

Figure 1:
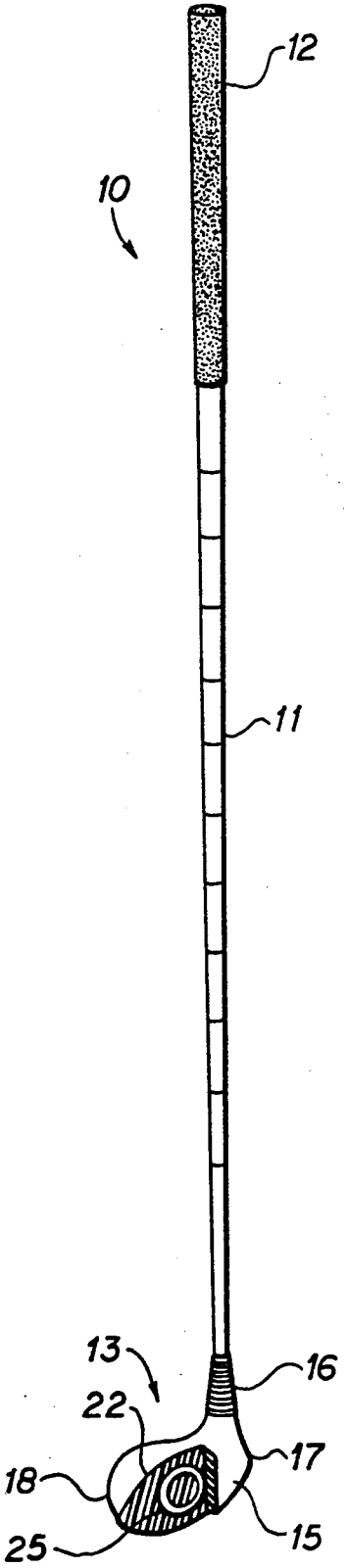
FIG. 1 is a perspective view of a golf club that embodies principles of the invention in a preferred form, shown with a portion of the club head removed for clarity of description.
Figure 2:
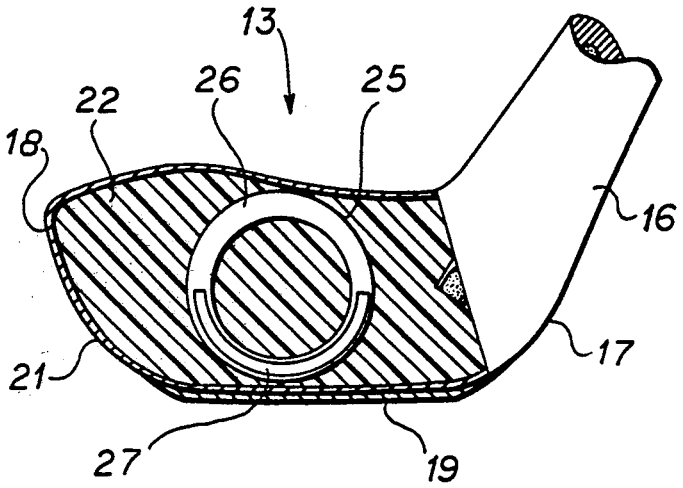
FIG. 2 is a front view of the golf club head of FIG. 1 shown partly in cross-section.

With reference next to the drawing, there is shown in FIG. 1 a golf club 10 embodying principles of the present invention having an elongated shaft 11, a resilient handle or grip 12 mounted to one end of the shaft, and a golf club head 13 mounted at an opposite end of the shaft. The club head 13 shown is typically referred to as a "wood" even though it may be constructed from wood, metal, or composites of plastics, ceramics and carbons.

The club head has a front surface face 15, a hosel 16, a heel 17, a toe 18 and a metal sole plate 19. The club head 13 has a metal casing 21 which encases a substantially solid, interior portion 22 made of expanded polystyrene. The club head has an annular tube 25 mounted in portion 22 which forms an annular channel 26. A weight, in the shape of an arcuate rod 27, is mounted within the tube 25 for free movement along the channel 26. The channel is lubricated with a thin oil to facilitate weight movement.

Figure 3:
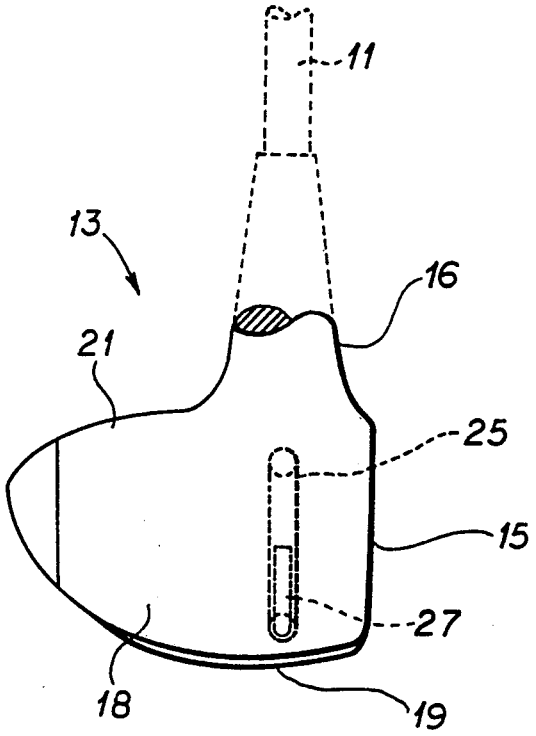
FIG. 3 is a side view of the golf club head of FIG. 1.

The annular channel 26 here is oriented so as to be generally aligned with the shaft 11, as best shown in FIG. 3, substantially parallel with the club head face 15. By "substantially parallel" here is meant between parallel to the club face to an angle from the club face slightly greater than the club head loft. The loft being the angle between the club head face while the club is at rest on the ground and a vertical line. For example, if the club head has a 18° loft the annular channel is oriented between 0° to slightly greater than 18° from the club head face.

Figure 4:
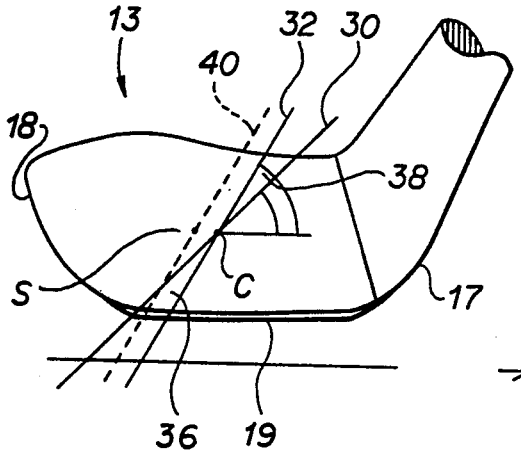
FIG. 4 and 5 are front views of the golf club head of FIG. 1.

As shown in FIG. 4, as the golf club is swung in an ideal swing plane for the golf club, represented by plane 30, the centrifugal force of the club head is believed to extend along plane 30 with the center of inertia of the club head located at point C. Here, the toe portion of the club head, i.e. that portion of the club head located between the toe 18 and the plane 30, has an inertia equal to the inertia of the heel portion of the club head, i.e. that portion of the club head located between the heel 17 and the plane 30. In other words, the mass of the toe portion multiplied by its average velocity equals the mass of the heel portion multiplied by its average velocity. However, as the golf club is swung in a more upright swing plane, as represented by plane 32, the centrifugal force slants accordingly along plane 32. Here, the toe portion of the club head consists of that portion of the club head located between the toe 18 and the swing plane 32, and the heel portion of the club head consists of that portion of the club head located between the heel 17 and the plane 32.

A comparison between the ideal swing plane 30 and the upright swing plane 32, and their corresponding toe and heel portions of the club head, reveals that the toe portion of the club head of an upright swing plane now includes a portion 36 of the club head located between planes 30 and 32 and generally below point C, and now excludes a portion 38 of the club head located between planes 30 and 32 and generally above point C. Conversely, the heel portion of the club head of an upright swing now includes portion 38 and excludes portion 36.

Portion 36 includes a section of the metallic sole plate 19 thereby making it heavier than portion 38. Here, with respect to plane 32 the mass of the toe portion multiplied by its average velocity is greater than the mass of the heel portion multiplied by its average velocity. This change in the mass distribution of the club head, and the fact that the toe portion of the club head has a higher average velocity than the heel portion, is believed to cause the center of inertia to shift somewhat towards the toe 18 to point S. This establishes an imaginary centrifugal force which extends along a plane 40 oriented parallel to plane 32 and wherein the inertia of the toe portion of the club head equals the inertia of the heel portion of the club head. In other words, with respect to plane 40 the mass of the toe portion multiplied by its average velocity equals the mass of the heel portion multiplied by its average velocity.

Figure 6:
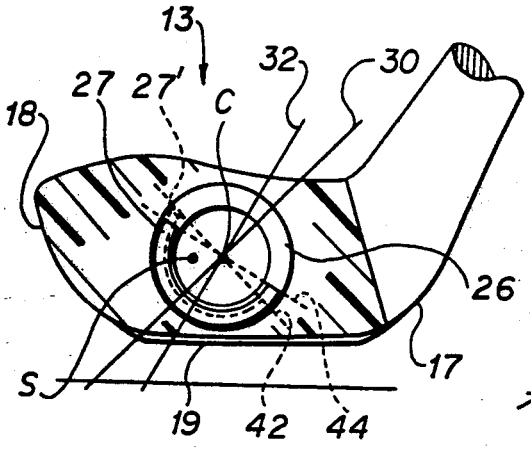
FIG. 6 and 7 are front views of the golf club head of FIG. 1 shown partly in cross-section with a portion of the cross-sectioning eliminated adjacent the internal components for clarity.

As shown in FIG. 6, as the club is swung in the ideal swing plane 30 the weight 27', shown in phantom lines and slightly thinner for clarity, is centrifugally forced along channel 26 to a position bisected by plane 30. With the weight 27' in this position the center of inertia of the club head is located at point C. A phantom line 42 oriented perpendicular to plane 30 extends through the ends of the weight 27' and through point C. Should the golf club be swung in the upright swing plane 32, the weight 27 is centrifugally forced along channel 26 to a position bisected by plane 32. Here, phantom line 44 oriented perpendicular to plane 32 extends through the ends of the weight 27 and through point C. In comparing the two relative swings, and the location of the weight 27 relative to each swing, it can be seen that the weight 27 shifts so that the toe portion of the club head of an upright swing excludes a proportionate amount of the weight 27 located between lines 42 and 44 and generally between the toe 18 and point C, while the heel of the club head portion of the upright swing includes a proportionate amount of the weight located between lines 42 and 44 and between the heel 17 and point C. This redistribution of the mass of the weight 27 causes the heel portion of the club head to become heavier thereby causing the center of inertia to shift back away from point S to point C. Thus, the center of inertia remain located on point C even though the club is swung in the more upright swing plane. Here, with respect to plane 32 the mass of the toe portion multiplied by its average velocity equals the mass of the heel portion multiplied by its average velocity. This centering of the inertia in turn serves to counter the torquing effect of the golf club that would otherwise occur.

Figure 5:
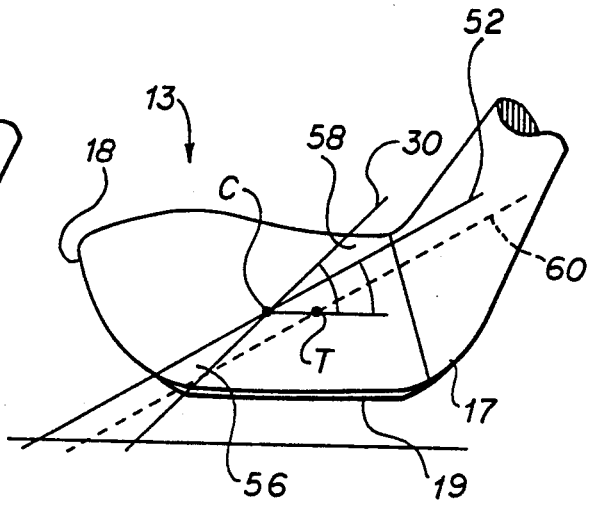

As shown in FIG. 5, and as previously described, as the golf club is swung in the ideal swing plane represented by plane 30, the centrifugal force of the club head extends along plane 30 with the center of inertia of the club head located at point C. Here, the toe portion of the club head, i.e. that portion of the club head located between the toe 18 and the plane 30, has an inertia equal to the inertia of the heel portion of the club head, i.e. that portion of the club head located between the heel 17 and the plane 30. In other words, the mass of the toe portion multiplied by its average velocity equals the mass of the heel portion multiplied by its average velocity. Here, however, as the golf club is swung in a flatter swing plane, as represented by plane 52, the centrifugal force is accordingly extends along plane 52. Here, too, the toe portion of the club head consists of that portion of the club head located between the toe 18 and the swing plane 52, and the heel portion of the club head consists of that portion of the club head located between the heel 17 and the plane 52.

A comparison between the ideal swing plane 30 and the flatter swing plane 52, and their corresponding toe and heel portions of the club head, reveal that the toe portion of the club head of a flatter swing plane now excludes a portion 56 of the club head located between planes 30 and 52 and generally below point C, and now includes a portion 58 located between planes 30 and 52 and generally above point C. Conversely, the heel portion of the club head of a flatter swing excludes portion 58 and includes portion 56.

Portion 56 includes a section of the metallic sole plate 19 thereby making it heavier than portion 58. Here, with respect to plane 52 the mass of the toe portion multiplied by its average velocity is less than the mass of the heel portion multiplied by its average velocity. This change in the mass distribution of the club head is believed to cause the center of inertia to shift somewhat towards the heel 17 to point T, thereby establishing an imaginary centrifugal force which extends along plane 60 oriented parallel to plane 52 and wherein the inertia of the toe portion of the club head equals the inertia of the heel portion of the club head. In other words, with respect to plane 60 the mass of the toe portion multiplied by its average velocity equals the mass of the heel portion multiplied by its average velocity.

Figure 7:
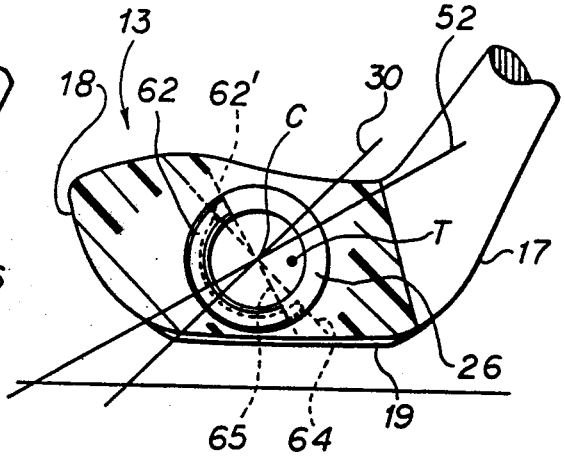

As shown in FIG. 7, as the club is swung in the ideal swing plane 30 the weight 62', shown in phantom lines and slightly thinner for clarity, is centrifugally forced along channel 26 to a position bisected by plane 30. With the weight 62' in this position the center of inertia of the club head is located at point C. A phantom line 64 oriented perpendicular to plane 30 extends through the ends of the weight 62' and through point C. Should the golf club be swung on the flatter swing plane 52, the weight 62 is centrifugally forced along channel 26 to a position bisected by plane 52. Here, phantom line 65 oriented perpendicular to plane 52 extends through the ends of the weight 62 and through point C. In comparing the two relative swings and the location of the weight 62 relative to each swing, it can be seen that the weight 62 shifts so that the heel portion of the club head of a flatter swing excludes a proportionate amount of the weight 62 located between lines 64 and 65 and generally between the heel 17 and point C, while the toe portion of the club head of the flatter swing includes a proportionate amount of the weight located between lines 64 and 65 and between the toe 18 and point C. This redistribution of the mass of the weight 62 causes the toe portion of the club head to become heavier thereby causing the center of inertia to shift back away from point T to point C. Thus, the center of inertia remain located on point C even though the club is swung at a flatter swing plane. Here, with respect to plane 52 the mass of the toe portion multiplied by its average velocity equals the mass of the heel portion multiplied by its average velocity. Again, this centering of the inertia counters the torquing effect of the golf club.

Figure 9:
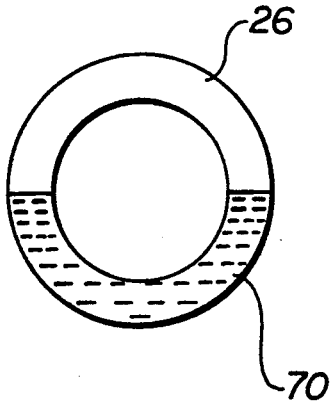
FIG. 9 is a front view of internal components of a golf club head in an alternative form of the invention.
Figure 10:
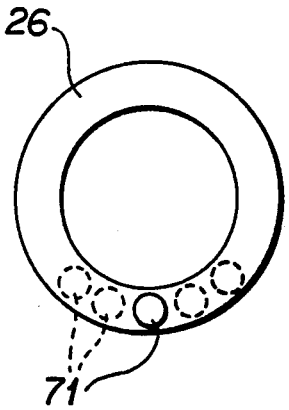
FIG. 10 is a front view of internal components of a golf club head in an alternative form of the invention.

As an alternative, the weight within the channel 26 may be comprised of a heavy liquid 70, as shown in FIG. 9, or of one or more round weights 71, as shown in FIG. 10. As another alternative the annular channel 26 may be formed by voiding a portion of the solid portion of the club head, thereby eliminating the tube 23. Also, the channel 26 need not be completely annular, for example a C-shaped channel would also suffice.

Figure 8:
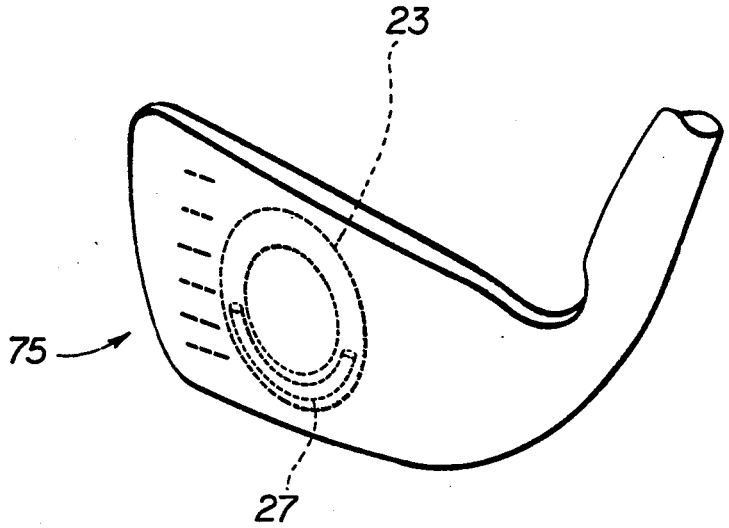
FIG. 8 is a perspective view of a golf club head of another configuration that embodies principles of the invention in a preferred form.

It should be understood that principles of the invention also applied to other types of golf club heads 75 such as those typically referred to as "irons", as shown in FIG. 8, and putters.

It thus is seen that a golf club which maintains its center of inertia or sweet spot in substantially the same location, regardless of the swing plane orientation or club head velocity, is now provided. It should be understood however that the just described embodiment merely illustrates principles of the invention in its preferred form. Many modifications, additions and deletions may, in addition to those expressly recited, be made thereto without departure from the spirit and scope of the invention as set forth in the following claims.

I claim:

1. A golf club comprising a shaft and a head mounted at an end of said shaft, said head having a face, and wherein said head has a generally annular channel mounted wholly therein and oriented substantially parallel to said face, and a weight located within said channel for free movement therein, whereby the weight may move to different radially locations within the channel as the club is swung to distribute the mass of the head to counter torquing effects of the club.

2. The golf club of claim 1 wherein said weight is an arcuate rod.

3. The golf club of claim 1 wherein said weight is a liquid.

4. The golf club of claim 1 wherein said weight comprises a ball.

5. A golf club head comprising a casing having a face, a generally annular tube mounted wholly within said casing and oriented substantially parallel to said face, and a weight movable to different radial positions within said tube, whereby the center of inertia of the club head during movement is dependent upon the position of the weight.

6. The golf club head of claim 5 wherein said weight is an arcuate rod.

7. The golf club head of claim 5 wherein said weight is a liquid.

8. The golf club head of claim 5 wherein said weight comprises a ball.

* * * * *